US008870972B2

(12) United States Patent
Grier et al.

(10) Patent No.: US 8,870,972 B2
(45) Date of Patent: Oct. 28, 2014

(54) SUBLIMATION DYING OF TEXTILES AND OTHER MATERIALS

(75) Inventors: William Grier, Rancho Cucamonga, CA (US); Van Schmelzter, Escondido, CA (US)

(73) Assignee: Airdye Intellectual Property, LLC, Wilmington, DE (US)

( * ) Notice: Subject to any disclaimer, the term of this patent is extended or adjusted under 35 U.S.C. 154(b) by 667 days.

(21) Appl. No.: 11/364,640

(22) Filed: Feb. 27, 2006

(65) Prior Publication Data

US 2006/0199733 A1 Sep. 7, 2006

Related U.S. Application Data

(60) Provisional application No. 60/658,303, filed on Mar. 2, 2005.

(51) Int. Cl.

| | |
|---|---|
| ***D06P 5/28*** | (2006.01) |
| ***B41F 3/44*** | (2006.01) |
| ***B41F 16/02*** | (2006.01) |
| ***B41M 5/035*** | (2006.01) |

(52) U.S. Cl.

CPC ..... *B41M 5/035* (2013.01); *B41F 16/02* (2013.01); *D06P 5/004* (2013.01); *B41M 5/0358* (2013.01)

USPC ..... 8/471; 68/8; 101/186; 101/250

(58) Field of Classification Search

USPC ..... 8/471; 101/186, 250; 68/8

See application file for complete search history.

(56) References Cited

U.S. PATENT DOCUMENTS

| | | | | |
|---|---|---|---|---|
| 4,116,022 | A * | 9/1978 | Lopata et al. | 68/5 D |
| 5,160,505 | A * | 11/1992 | Seveno et al. | 8/471 |
| 5,284,816 | A * | 2/1994 | Stephenson | 503/227 |
| 5,940,806 | A | 8/1999 | Danial | |
| 6,132,547 | A * | 10/2000 | Marsh | 156/230 |
| 6,393,988 | B1 * | 5/2002 | Gaskin | 101/484 |
| 6,447,629 | B1 * | 9/2002 | Thompson et al. | 156/230 |
| 6,467,898 | B2 * | 10/2002 | Codos et al. | 347/102 |
| 6,796,647 | B2 * | 9/2004 | Kosaka et al. | 347/103 |
| 6,814,831 | B2 * | 11/2004 | Drake | 156/230 |
| 2003/0035675 | A1 | 2/2003 | Emery et al. | |
| 2003/0217685 | A1 | 11/2003 | Aldridge | |

* cited by examiner

*Primary Examiner* — Harold Pyon
*Assistant Examiner* — Katie L Hammer
(74) *Attorney, Agent, or Firm* — Fish & Tsang, LLP

(57) ABSTRACT

Sublimation dyeing uses first and second donors, with heat being applied simultaneously from both sides of the object. Receivers can be woven, non-woven, knitted or not knitted, or any combination of these, or any other factors, and are contemplated to include fabrics used for clothing, banners, flags, carpets, wall hangings, and so on. Process parameters use lower temperature and longer dwell times than for one-sided sublimation printing, most preferably dwell times of between 70 seconds and 120 seconds, and a sublimation temperature of less than 400° F. (204.4° C.). Solids and patterns can be reproducibly printed, even in small lots, and can facilitate just in time production of clothing and other materials.

24 Claims, 4 Drawing Sheets

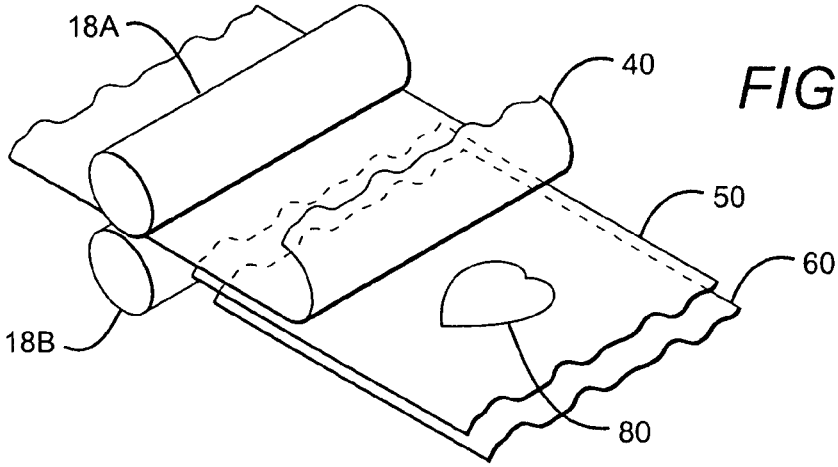
FIG. 4
FIG. 5A
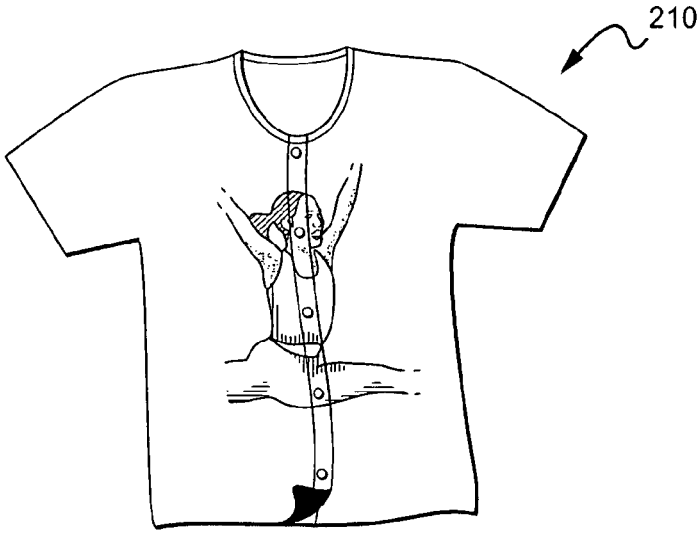
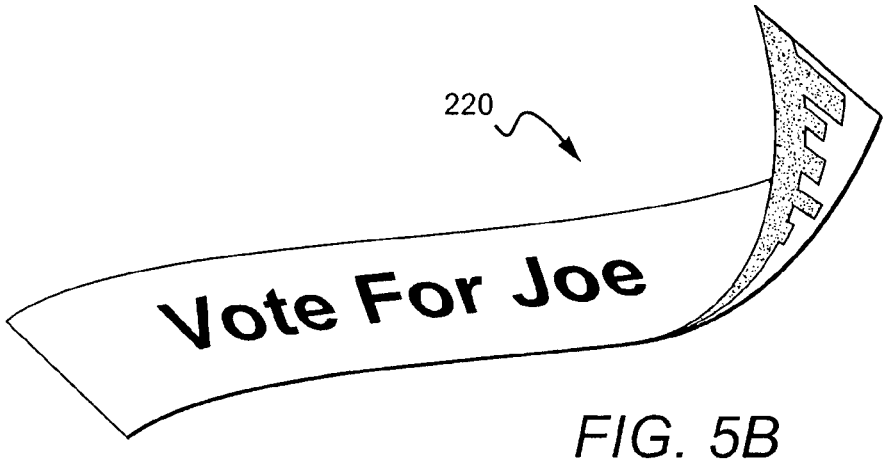
FIG. 5B

SUBLIMATION DYING OF TEXTILES AND OTHER MATERIALS

This application claims priority to U.S. provisional application Ser. No. 60/658303 filed Mar. 2, 2005.

FIELD OF THE INVENTION

The field of the invention is dying of textiles and other materials.

BACKGROUND

Since before recorded history man has attempted to decorate fabric with color. Starting with hides, and later woven and knitted materials, the traditional approach has been to liquefy the color by suspending it in a solution of water or some other fluid. The object to be dyed is then submersed in the solution or coated with it to produce the desired color.

Great skill was required to produce the desired color using this classic vat dyeing method, and even with today's sophisticated equipment great skill is still required to produce "dye lots" of the same color. Producing an exact color match is a product of recreating the exact intersection of color concentration, energy (usually heat) object material and processing time over and over in a chamber with constantly changing dynamics.

Skilled craftsmen all over the world dye hundreds of thousands of tons of fabric. As new sources of fiber (mostly polymer based) are developed, vat dying has become more difficult and problematic, among other things causing considerable water pollution. The net effect is unreliability in matching colors, and increase in energy use and dangerous effluents.

One solution is to use sublimation technology. In that process special dyes are printed onto a donor, the paper is juxtaposed against the receiver, and heat is applied to the outside surface of the paper. The heat causes the dyes to explode into a dye-laden superheated air colorant, and drives the colorant into the receiver. This use of superheated air as the carrying agent dramatically reduces both energy usage and pollution.

Although sublimation technology has been used for decades to produce relatively small, and usually complex images, it has never been used commercially in place of dyeing to cover relatively large areas of a receiver. The reason is that images are often recorded on the donor with defect lines. Such lines are rather irrelevant for small, complex images, because the area of deposition of any one visually distinct portion of the image is relatively small. But defect lines can produce very noticeable defects in printing of solids and relatively large, regular patterns.

Sublimation printing has also been commercially infeasible for double sided printing because of color differences on the two sides. Even if the dyes are identical on both sides of the receiver, the second application of dye tends to push the first application out of the paper and onto a take up paper, thereby producing visually different color densities. See e.g. US 2003/0217685 to Mason et al. (pub. Nov. 27, 2003), and US 2003/0035675 to Emery at al. (pub. Feb. 20, 2003). These and all other publications referred to herein are incorporated by reference in their entirety.

Still another disadvantage of sublimation printing is that it is entirely additive. Thus, if one prints a full color image on a yellow background, one must print over top of the yellow background, which distorts the colors of the image. Where multiple images or multiple passes are used, there can are also significant registering problems. See e.g., U.S. Pat. No. 6,393,988 to Gaskin (May 28, 2002).

All of these problems are exacerbated when manufacturing material with printing on both sides. Even where the fabric is sufficiently thick to prevent images from showing through from one side to another, inks and other colorants tend to interfere with color clarity due to bleed through. The current technology sews or uses a temperature sensitive adhesive to bind together two separately printed fabrics (for example with banners), and may also interpose an interliner or other intermediate stiffening sheet (for example with shirt collars). But such solutions are relatively expensive, and can result in an undesirable pillowing effect.

What is needed are methods and apparatus that employ sublimation techniques to print solids and other large blocks on both sides of fabrics and other receivers, with good color consistency and vastly improved consistent color saturation. It would also be desirable to apply such methods to legacy equipment. In particular, there is a need to permanently dye fabric using non-aqueous coloration process on a conventional heat transfer device, which preferably achieves exact or near exact color matching.

SUMMARY OF THE INVENTION

The present invention provides apparatus, systems and methods in which one or more dyes are placed on first and second donors, the donors are positioned adjacent a receiver, and heat is applied to simultaneously sublimate the dyes onto the receiver.

The dyes can be printed on the donors in any suitable manner, including for example, solids, repeating patterns, and even complex images. Such printing can be done using any suitable mechanism, including preferably a roller coater for solids and an ink jet printer for complex pattern and images. Ordinary supplies can be used, including for example, known sublimation dyes, and known paper or other donors.

The receiver can be any material into which dyes can be sublimated. Receivers can be woven, non-woven, or some combination of the two, and can be fabrics used for clothing, banners, flags, carpets, wall hangings, and so on.

Sublimating heat can advantageously be provided simultaneously from both sides of the receiver, preferably using a continuous heat press. As used herein, the term "simultaneously" means that there is at least some temporal overlap of the heat from both sides of the receiver.

The first and second donors can be positioned in any suitable manner, for example, on opposite sides of the receiver, or on the same side of the receiver with the second donors being sandwiched between the first donors and the receiver. Equipment and other devices for manufacturing according to the principles discussed herein can preferably operate on a continuous basis, and in that respect can advantageously utilize a roller or other continuous heat press, and first, second, and third sets of rollers containing the first and second donors, and the receiver, respectively. Some existing equipment can be modified to operate according to the principles discussed herein, for example, by adjusting the sublimation dwell time as discussed above.

All sorts of useful articles of manufacture can be printed as described herein, including clothing, carpets, banners, flags, wall coverings, and so forth.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWING

FIG. 4 is a schematic of operation of the equipment of FIG. 1 in which a second (intermediate) donor is interposed between a first (top) donor and the receiver.

FIGS. 5A-5E are line sketches of a shirt 210, a banner 220, a flag 230, a carpet 240, and a wall hanging 250, respectively, manufactured according to the teaches herein.

DETAILED DESCRIPTION

Figure 1:
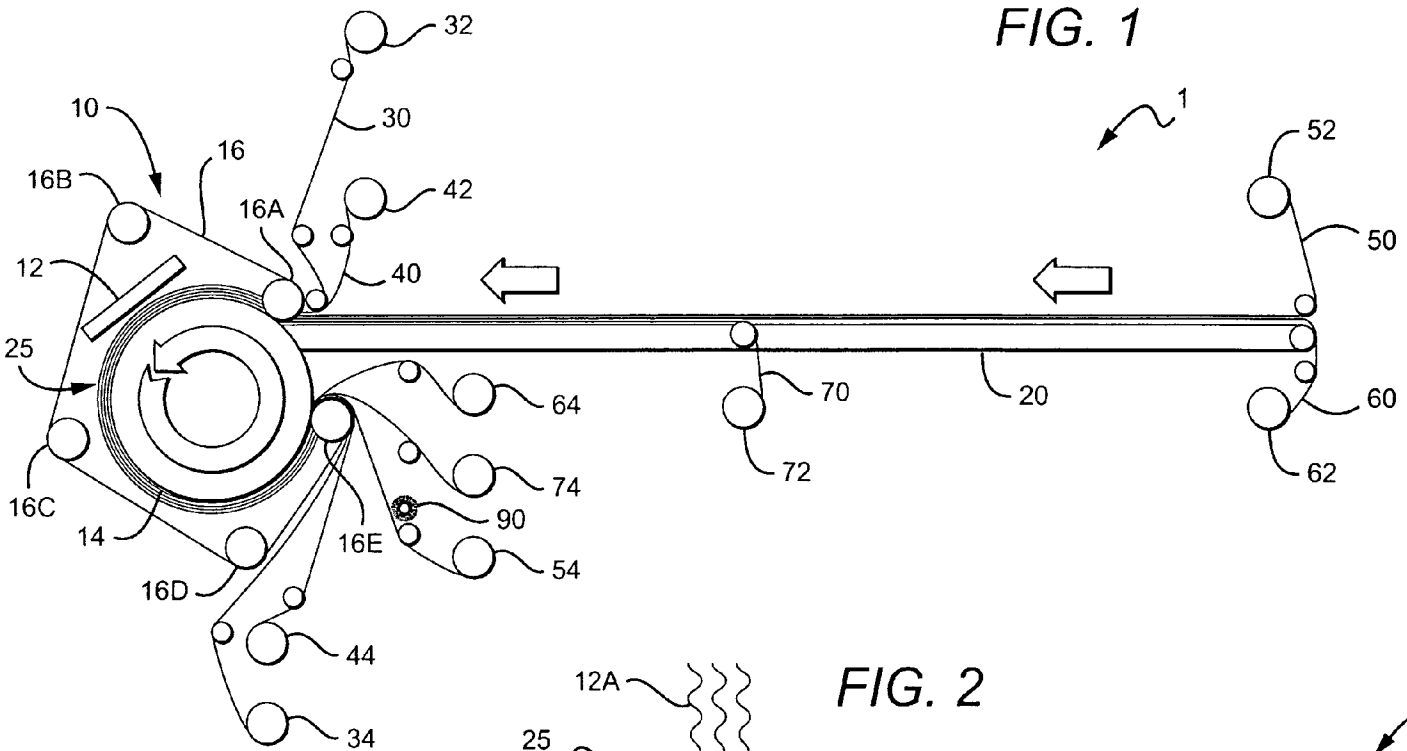
FIG. 1 is a schematic of processing equipment according to the teaches herein.

In FIG. 1, processing equipment 1 generally includes a rotary heating portion 10 and a work table 20. Positioned on the machine is a continuous work piece 25 (also shown in FIG. 2) comprising: first tissue 30 with corresponding first tissue feed roll 32 and first tissue take up roll 34; first donor paper 40 with corresponding first donor feed roll 42 and first donor take up roll 44; receiver 50 with corresponding receiver feed roll 52 and receiver take up roll 54; second donor paper 60 with corresponding second donor feed roll 62 and second donor take up roll 64; and second tissue 70 with corresponding second tissue feed roll 72 and second tissue take up roll 74. Also shown in FIG. 1 is a suede brush 90, that restores texture to the receiver 50 after dyeing.

The equipment is preferably operated in a continuous manner, and to that end the heating portion 10 preferably includes a rotary primary heating element 12, a fixed secondary heating element 14, and a heat conductive web 16. The web 16 is positioned by positioners 16A-16E. The rotation speed, configuration and dimensions of the heating portion 10 determine the dwell time of sublimating heat upon the sandwiched work piece of first tissue 30, first donor 40, receiver 50, second donor 60, and second tissue 70. Dwell time, temperature, and pressure are preferably adjusted by controls (not shown). Despite a current preference for continuous processing, it is also contemplated that embodiments of the inventive subject matter could be practiced in a discontinuous manner, for example with sandwiched work pieces being assembled, and heat and pressure applied in a piece by piece manner. In that regard it is specifically contemplated that the receiver could be cut from a bulk material.

Figure 2:
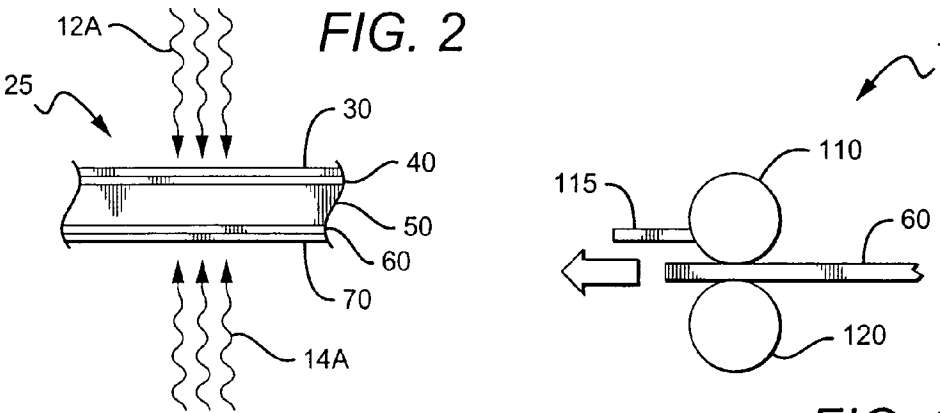
FIG. 2 is a schematic of a sandwiched work piece receiving heat from both sides.

There are existing machines (e.g. Monti Antonio™, Practix™ and other cylinder based machines) that could be modified to operate according the inventive concepts described herein. One key aspect is that instead of the previously known configuration in which the work piece (not shown) consists of only a receiver sandwiched between a donor and a tissue, the inventive current work piece 25 comprises a receiver 50 sandwiched between two donors 40, 60, and two tissues 30, 70. Another key aspect is that instead of sublimating heat being applied from a single direction heat source→donor→receiver→tissue (not shown), sublimating heat according to the inventive subject matter is applied simultaneously from both directions. In FIG. 2 this is depicted as primary heat 14A coming from primary heat source 14, and secondary heat 12A emitting from secondary heat source 12.

As discussed above, the term "simultaneously" means that there is at least some temporal overlap. Thus, it is contemplated that heat sufficient to sublimate would be applied from the two sides of the receiver with an overlap of at least 5 seconds, more preferably at least 10 seconds, 20 seconds, 40 seconds, 60 seconds, and most preferably at 80 seconds. Viewed from another perspective, a period of sublimating heat from the second side overlaps with a period of sublimating heat from the first side by at least 5%, more preferably at least 10%, 20%, 40%, 60%, and most preferably at 80%. Sublimating heat on any given side is preferably provided for a dwell time of between 70 and 120 seconds, more preferably between 85 and 95 seconds, and most preferably about 90 seconds. Sublimation temperature is preferably no more than 400° F. (204.4° C.), and more preferably less.

The first and second tissues 30, 70 can be selected from known take up tissues used in the industry. In contrast to the prior art, the tissues are not used in the current embodiments to absorb dyes that pass entirely through the receiver 50 and opposite donor 40 or 60. That is unnecessary because the donor materials are nearly or entirely impermeable to passage of dyes. Instead the tissues 30, 70 in embodiments of the present invention serve to protect the mechanical parts from excess colorant. The first and second donors 40, 60 can be selected from known donor papers, or other materials used in the industry. The donor material can be any thin sheet that is substantially impassible to dye from side to side, but which has a surface to which a dye can be temporarily held. It should also be appreciated that the terms "dye" and "dyes" are used in the broadest possible sense to include inks, and indeed any chemical composition that can be transferred to a receiving material to color that material. Thus, the terms "dye" and "dyes" include chemical compositions that can change color depending upon temperature or other conditions, and even chemical compositions that are colorless when applied, but turn color upon exposure to moisture, or high temperature.

Figure 3:
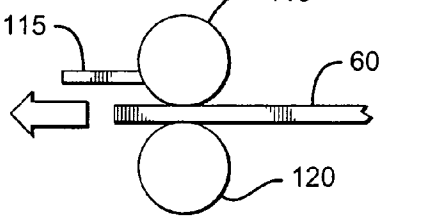
FIG. 3 is a schematic of system that roller coats a donor with a solid color.
Figure 5C:
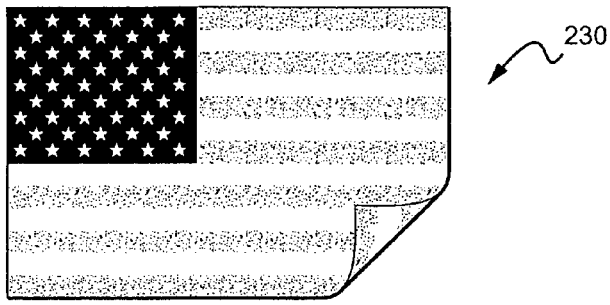
Figure 5D:
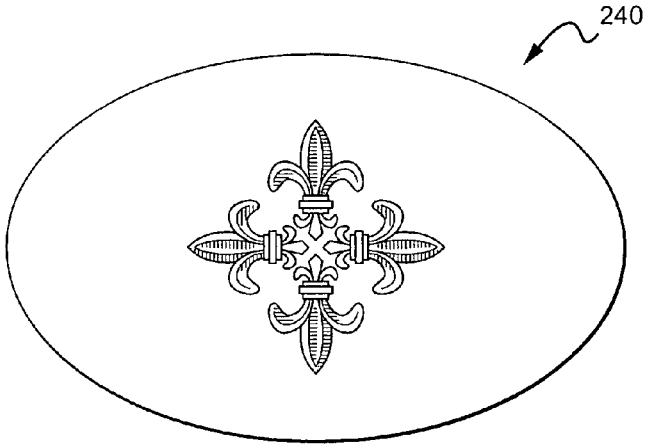
Figure 5E:
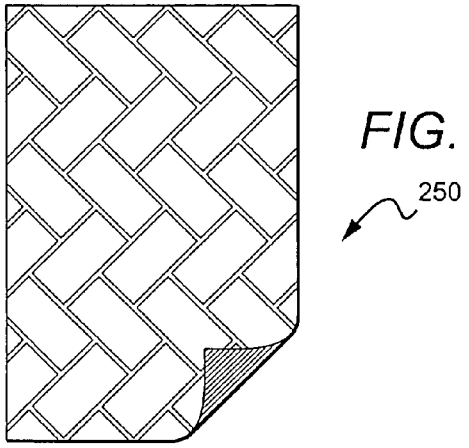

To that end, donors 40, 60 can be printed with solid colors, or at least relatively large areas of solids and/or large repeating patterns. It is especially contemplated that donors 40, 60 can be printed with solids or large repeating patterns having contiguous areas of at least 10 $cm^2$, 50 $cm^2$, 100 $cm^2$, 200 $cm^2$, 400 $cm^2$. To avoid the color shifts that are prevalent with ink jet and other printed donors, it is preferable when printing solids, or patterns including a single color, to use a roller coater 100 to ink one or both of the donors 40, 60 (see FIG. 3). Using roller coater 100 it is even commercially practicable to print the entire useable area of the receiver with a solid or simple repeating pattern, without visually offensive print lines. By printing both donors 40, 60 in this manner, receivers can be produce that have the same color of solids on both sides, one color of solid on one side and a different color of solid on the other side, a solid on one side and a pattern on the other, and so forth. Printing patterns on both sides is also entirely feasible, although back-to-back registration of the images is still somewhat problematic. Complex patterns and even photographic or other images can also be printed, with third, fourth, and other colors. Indeed, to simplify the drawing, FIG. 1 should be interpreted generically as including all such combinations.

This ability to print an image or light-colored pattern on one side of a fabric, and a different solid and/or large repeating pattern on the other side, is expected to satisfy a very strong unmet need in the market. Ordinary vat dying is not commercially viable for this purpose because the process necessarily colors both sides, and adding a pattern onto a surface that already has a color (especially a dark color), results in undesirably murky images and patterns. Thus, a particularly strong application for aspects of the equipment, processes and methods described herein is to provide an image or light-colored pattern on one side of a fabric, and a solid and/or large repeating pattern of a dark or strong color, (e.g., black, blue or red) on the reverse side. In such instances the solid and/or large repeating pattern would preferably comprises a spot color so that it one can reproduce the color at will according to its digital value. But one could alternatively employ the four primary colors, one of the twenty-four secondary colors, or any other color.

The receiver 50 can be any material that can receive sublimation printing. This includes most especially polyesters and other synthetic polymers that absorb dyes at high temperature and pressure, with currently preferred receiver materials including the true synthetics or non-cellulosics (e.g., polyester, nylon, acrylic, modacrylic, and polyolefin), blends, and so forth. It is contemplated that receiver materials could also include natural fibers (e.g., cotton, wool, silk, linen, hemp, ramie, and jute), semi-synthetics or cellulosics (e.g., vicose rayon and cellulose acetate), but currently available colorants do not "take" very well with such fibers. Receivers can be flexible or rigid, bleached or unbleached, white or colored, woven, non-woven, knitted or non-knitted, or any combination of these or other factors. Thus, a receiver could, for example, include a woven material on one side and a non-woven or different woven material on the other side. Among other things, receivers are contemplated to include fabrics and fibers used for clothing, banners, flags, curtains and other wall coverings, and even carpets.

In FIG. 4, a receiver 50 is placed between a top donor 40 and a bottom donor 60 as in FIG. 1. Here, however, there is a piece donor 80 that is placed between the top donor 40 and the receiver 50, inserted prior to passing through optional rollers 18A, 18B (not shown on FIG. 1). The piece donor 80 blocks transfer of dye from the top donor 40 to the receiver 50 over the entire surface of the piece donor 80, while at the same time allowing transfer of the remaining area of top donor 40 onto receiver 50. This operation effectively makes a composite transfer consisting of solid or other background from the top donor 40, and a perfectly fit image or solid from the piece donor 80. Sandwiching tissues, if used, are not shown in this figure. The piece donor 80 could, of course, have different shapes from that shown, including for example complex shapes such as dragons or even doilies.

As used herein, the terms "article" and "articles" refer to textiles, clothing, carpets and other items that are thought of as three dimensional, as opposed to paper which is sufficiently thin to be thought of as being substantially two dimensional. All sorts of useful articles of manufacture can be printed as described herein. FIGS. 5A-5E, for example, are line sketches of a shirt, a banner, a flag, a carpet, and a wall hanging, respectively, manufactured according to the teaches herein.

The advantages of the methods and systems disclosed herein are enormous. For the first time, a manufacturer can fulfill small orders with almost perfect color consistency, in a commercially viable manner. Thus, a furniture store need not run large quantities of upholstery fabric to maintain color consistency from one month to the next, or even from one year to the next. Similarly, a shirt manufacturer can accurately produce the same color background on a T-shirt whether he is manufacturing 100,000 shirts, or 100 shirts one day and 100 shirts a month later. This flexibility can provide for the first time a methods of sourcing, producing, and marketing clothing in which the fabric is colored on an as needed basis, with a guaranteed color consistency. Those skilled in the art will appreciate that the inventive subject matter can be applied to any colored material, including clothes, handbags and other accessories, furniture, fabrics to cover non-furniture spaces in automobiles and other motor vehicles carpets, powder coated metals, plastics and so forth.

It is particularly contemplated that the teachings herein can be used to source "just in time" or small lot printing of any of these articles, which has heretofore been a practical impossibility. For example, small lots of an article can be practically printed and sourced even though the lots are no more than 5000, 1000, 100 or even 50 pieces, or from another perspective no more than 5000, 1000, 100 or even 50 meters of material.

Quite surprisingly, all of this can be accomplished with excellent color saturation and consistency, (with color difference between lots of no $\leq 0.1\ \Delta E$, $\leq 0.5\ \Delta E$, $\leq 0.02\ \Delta E$, and even $0.01\ \Delta E$.), even where different colors are applied to different sides of the fabric. Thus, using the parameters set forth herein, a shirt fabric can be digitally dyed with red on one side and blue on the other, or with one side a full color image on a blue back ground, and the other side being uniformly black. This ability to maintain color consistency to even small digital differences is the root of the term digital dying. Those skilled in the art will appreciate that this level of color consistency between commercial lots is just unheard of with prior art dying techniques.

It is also surprising that methods according to the present invention can be sufficiently rapid to compete with other dyeing techniques. For example, in a method of dyeing sections of a continuous recipient, wherein dye from rolls of donor paper or other sheeted material is sublimated into a recipient in adjacent sections, speeds of at least 95, 150, 200, 250, 300, 500, and 900 meters per hour can be achieved. Indeed, since dyes can be sublimated into both sides of a fabric simultaneously, these speeds can even be achieved dying different colors on the two sides. Still further, using intermediate donor sheets between the recipient and an overlying donor sheet, these same speeds can be achieved when transferring an image (full color or otherwise) into the recipient while simultaneously printing a solid background around the image.

Another huge advantage is that the digital dying process (simultaneous multiple sided sublimation) produces solids on both sides of a fabric or other material, with a consistency that previously could only be achieved with immersion dying. But here one would not have any excess dye and carrier to flush into the environment. As a result, the teachings herein can now make it commercially practicable for purchase orders for such small lots to specify delivery windows for "to be" printed materials that are effectively no more than 30, 14, 7, or even one or two calendar days. Still further, the printing can take place in the United States of America or other countries that ban commercial facilities releasing large quantities of dyes into the environment.

FIGS. 5A-5E are line sketches of a shirt 210, a banner 220, a flag 230, a carpet 240, and a wall hanging 250, respectively, manufactured according to the teaches herein.

Figure 6:
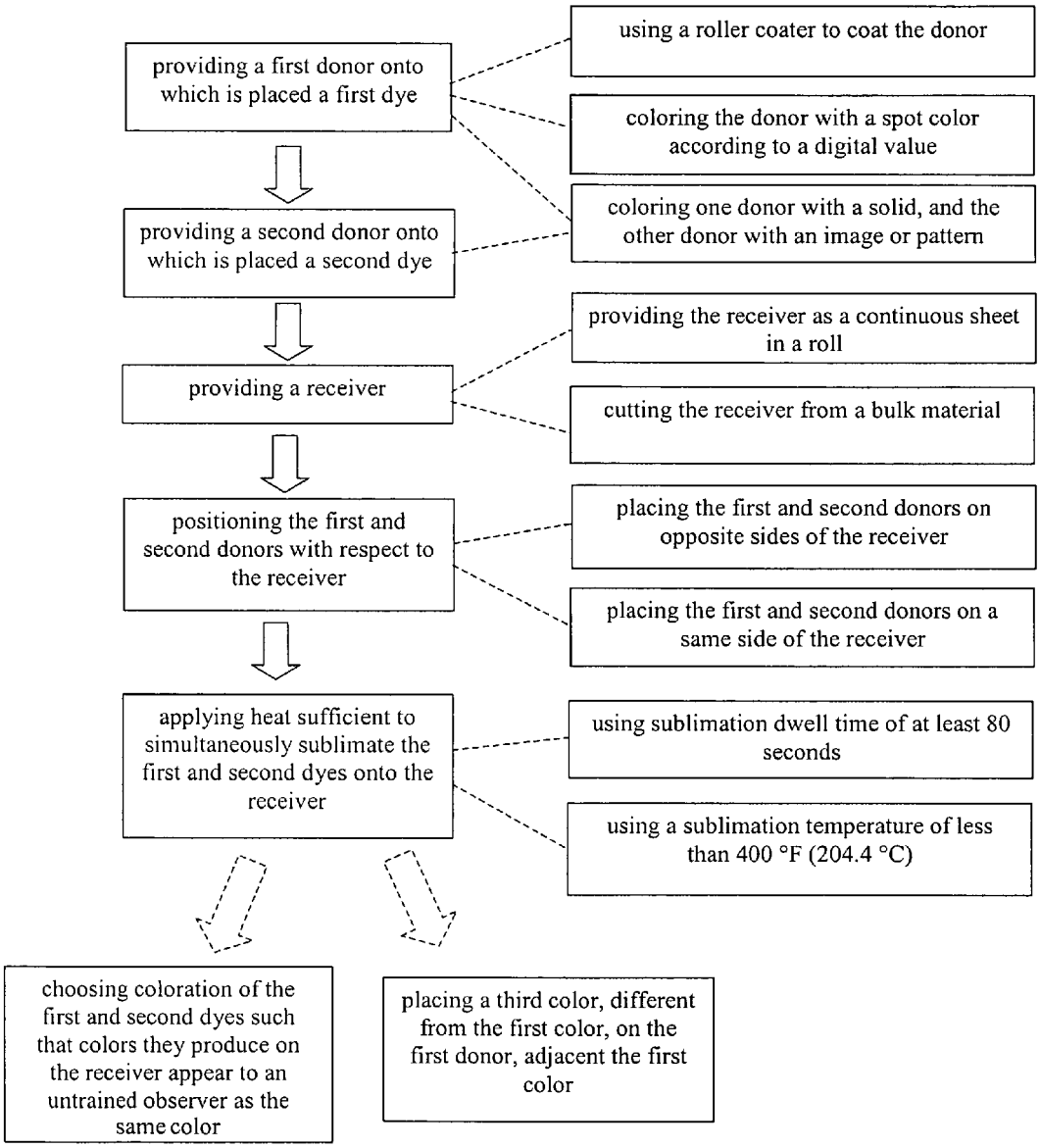
FIG. 6 is a flow chart showing steps in an embodiment according some of the teachings herein.

FIG. 6 is a flow chart showing steps in preferred embodiments according some of the teachings herein. The dashed lines show alternative and optional steps.

It should be apparent, however, to those skilled in the art that many more modifications besides those already described are possible without departing from the inventive concepts herein. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps could be present, or utilized, or combined with other elements, components, or steps that are not expressly referenced.

The invention claimed is:

1. A method of printing, comprising:

providing a first donor paper sheet on a cylinder based machine onto which is placed a first dye in the shape of a first pattern;

providing a second donor paper sheet onto which is placed a second dye in the shape of a second pattern;

wherein the first pattern is different from the second pattern;

providing a textile receiver, wherein the textile receiver is a separate sheet from the first donor and the second donor;

positioning the first and second donors by sandwiching the first and second donors on opposite sides of the textile receiver; and applying heat sufficient to simultaneously sublimate the first and second dyes onto the textile receiver so that at least a portion of the first dye on the textile receiver directly opposes at least a portion of the second dye on the textile receiver.

2. The method of claim 1, wherein the first dye is applied to the first donor such that the receiver receives a contiguous solid area of the first dye of at least 100 $cm^2$.

3. The method of claim 1, wherein the first dye is applied to the first donor such that the receiver receives at least one of: (a) a contiguous repeating pattern of at least 400 $cm^2$, and a contiguous solid area of the first dye of at least 400 $cm^2$.

4. The method of claim 1, wherein the first and second dyes have the same color.

5. The method of claim 1, further comprising choosing coloration of the first and second dyes such that colors they produce on the receiver appear to an untrained observer as the same color.

6. The method of claim 1, further comprising placing a third color, different from the first color, on the first donor, adjacent the first color.

7. The method of claim 1, further comprising using a roller coater to coat a dye onto the first donor.

8. The method of claim 1, wherein the receiver comprises a synthetic fiber.

9. The method of claim 8, wherein the receiver includes at least one of a rayon and a cellulose acetate.

10. The method of claim 1, wherein the receiver includes at least one of polyester, nylon, acrylic, modacrylic, and polyolefin.

11. The method of claim 1, wherein the receiver comprises a woven fabric.

12. The method of claim 1, wherein the receiver comprises a clothing fabric.

13. The method of claim 1, wherein the receiver comprises a banner and a flag fabric.

14. The method of claim 1, wherein the receiver comprises a carpet.

15. The method of claim 1, wherein the step of applying heat sufficient to simultaneously sublimate comprises applying sublimating heat to the first and second donors for first and second periods, respectively, wherein the first period overlaps the second period by at least 40 seconds.

16. The method of claim 1, wherein the step of applying heat sufficient to simultaneously sublimate comprises applying sublimating heat to the first and second donors for first and second periods, respectively, wherein the first period overlaps the second period by at least 60 seconds.

17. The method of claim 1, wherein the step of applying heat sufficient to simultaneously sublimate comprises applying sublimating heat to the first and second donors for first and second periods, respectively, wherein the first period overlaps at least 90% of the second period.

18. The method of claim 1, wherein the step of applying heat comprises adjusting a heat press to use a sublimation dwell time of at least 80 seconds.

19. The method of claim 1, wherein the step of applying heat comprises applying heat to opposing sides of the receiver.

20. The method of claim 1, wherein the step of applying heat comprises adjusting a heat press to use a sublimation temperature of less than 400° F. (204.4° C.).

21. The method of claim 1, wherein the step of applying heat comprises adjusting a heat press to use a sublimation dwell time of between 70 seconds and 120 seconds, and a sublimation temperature of less than 400° F. (204.4° C.).

22. The method of claim 1, further comprising cutting the receiver from a bulk material.

23. A method of printing, comprising:

providing a first donor paper sheet on a cylinder based machine onto which is placed a first dye in the shape of a first pattern;

providing a second donor paper sheet onto which is placed a second dye in the shape of a second pattern;

wherein the first pattern is different from the second pattern;

providing a textile receiver, wherein the textile receiver is a separate sheet from the first donor and the second donor;

placing the first and second donors on a same side of the textile receiver; and applying heat sufficient to simultaneously sublimate the first and second dyes onto the textile receiver so that at least a portion of the first dye on the textile receiver directly opposes at least a portion of the second dye on the textile receiver.

24. A method of printing, comprising:

providing a first donor paper sheet on a cylinder based machine onto which is placed a first dye in the shape of a first pattern;

providing a second donor paper sheet onto which is placed a second dye in the shape of a second pattern;

wherein the first pattern is different from the second pattern;

providing a textile receiver, wherein the textile receiver is a separate sheet from the first donor and the second donor;

sandwiching the second donors between the first donors and the receiver; and applying heat sufficient to simultaneously sublimate the first and second dyes onto the textile receiver so that at least a portion of the first dye on the textile receiver directly opposes at least a portion of the second dye on the textile receiver.

* * * * *